United States Patent [19]

Santoni

[11] Patent Number: 4,512,700

[45] Date of Patent: Apr. 23, 1985

[54] NESTING DRUMS-METHOD OF MAKING THE SAME

[75] Inventor: Cesar Santoni, Hamilton, Canada

[73] Assignee: Greif Bros. Corporation, Delaware, Ohio

[21] Appl. No.: 587,612

[22] Filed: Mar. 8, 1984

Related U.S. Application Data

[62] Division of Ser. No. 468,951, Feb. 23, 1983.

[51] Int. Cl.[3] ..... B21D 51/00

[52] U.S. Cl. ..... 413/4; 206/519

[58] Field of Search ..... 413/4, 24, 31; 206/67, 206/519, 520

[56] References Cited

U.S. PATENT DOCUMENTS

| | | | |
|---|---|---|---|
| 2,288,602 | 7/1942 | Benton | 206/520 |
| 3,386,625 | 4/1968 | Jacobsen | 220/67 |
| 3,425,382 | 2/1969 | Johnson | 206/519 |
| 3,949,877 | 4/1976 | Santoni | 206/519 |

FOREIGN PATENT DOCUMENTS

| | | | |
|---|---|---|---|
| 498403 | 12/1953 | Canada | 220/67 |
| 1009166 | 4/1977 | Canada | 206/519 |
| 1279124 | 11/1961 | France | 206/519 |
| 1490636 | 6/1967 | France | 206/519 |

*Primary Examiner*—Leon Gilden

*Attorney, Agent, or Firm*—Kane, Dalsimer, Kane, Sullivan & Kurucz

[57] ABSTRACT

A nesting drum and a method of making the same is provided. The drum comprises a shell which has a necking at the bottom to accommodate a double seam between the shell and the closure. The closure has a raised circular center and a plurality of ribs which re-enforce the shell to resist large loads.

10 Claims, 13 Drawing Figures

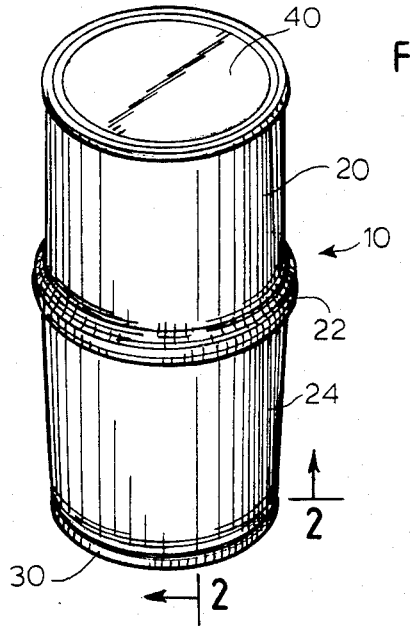
FIG.1
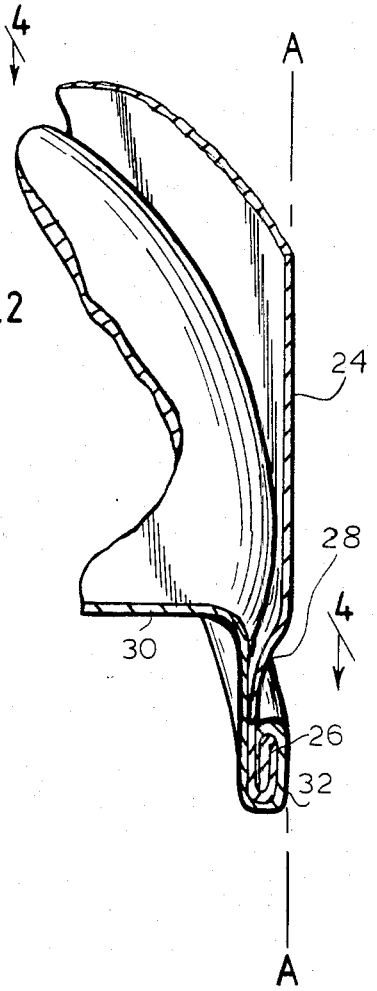
FIG.2
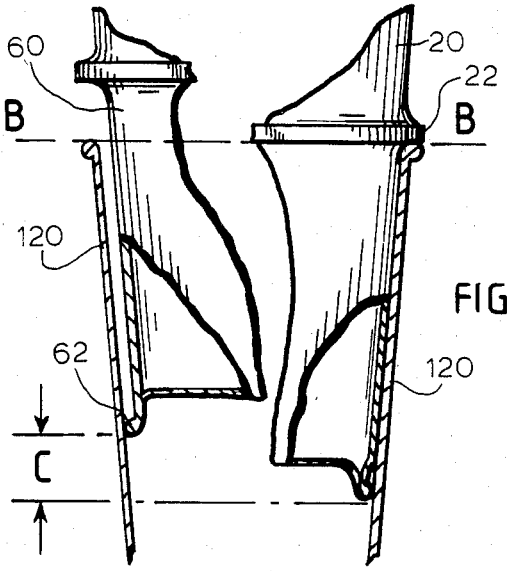
FIG.3
FIG.4
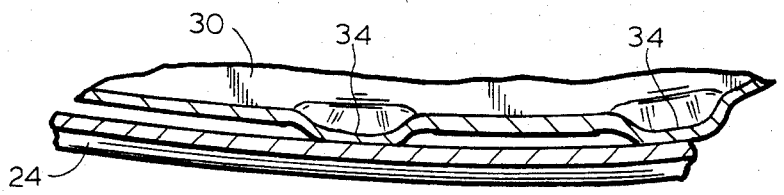

FIG.6
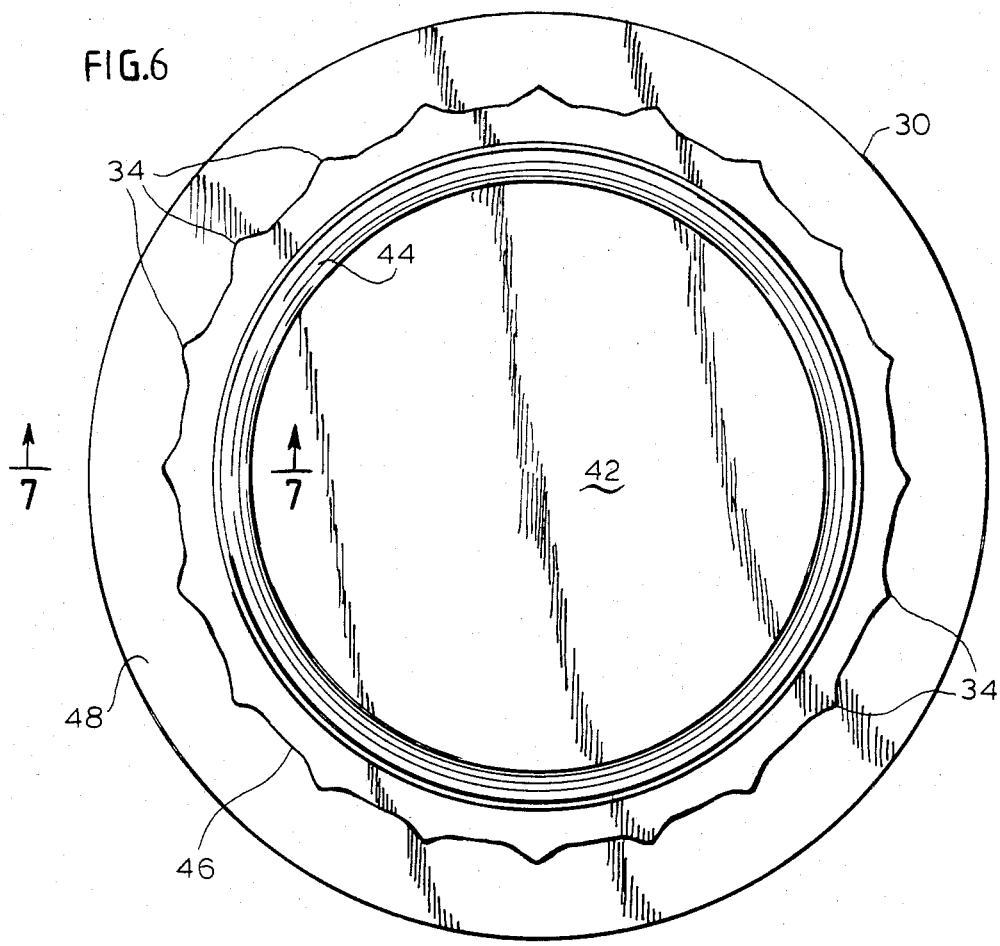
FIG.5
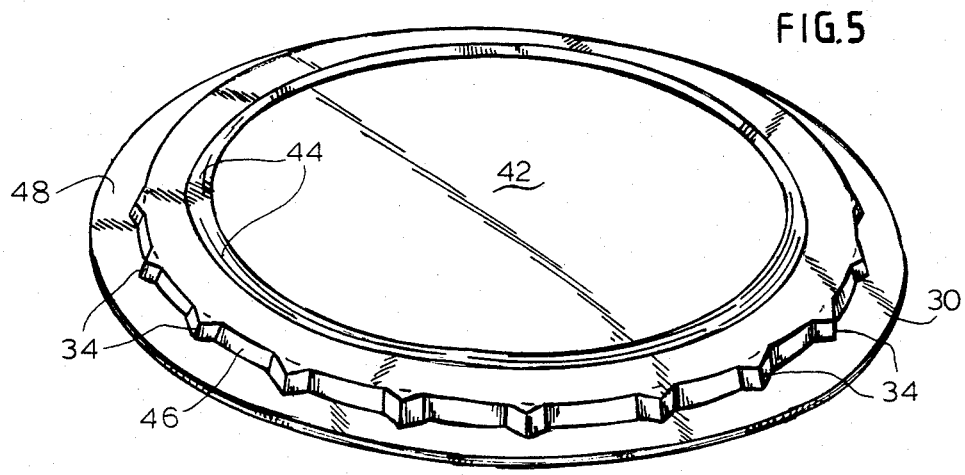
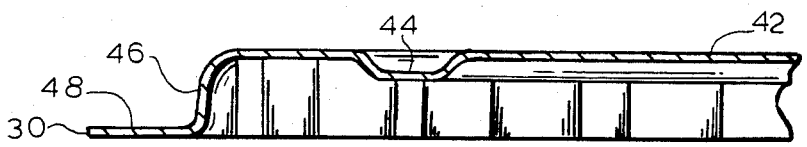
FIG.7

FIG.9
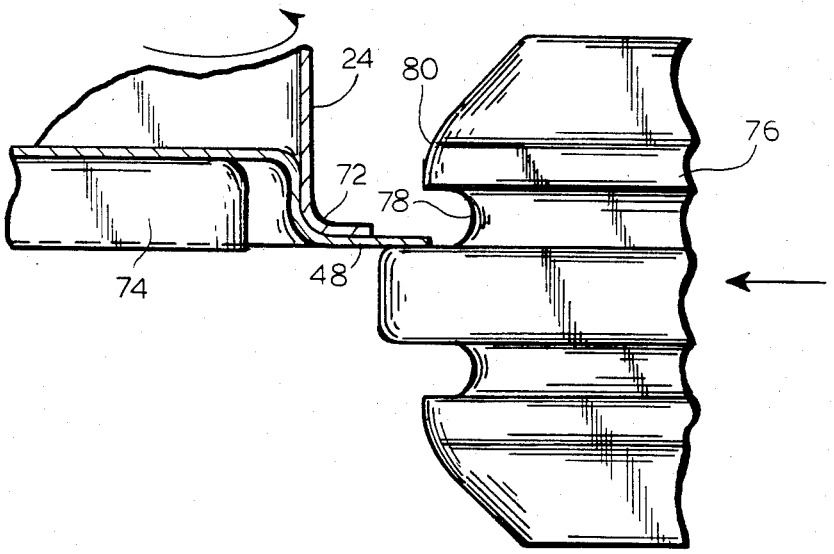
FIG.10
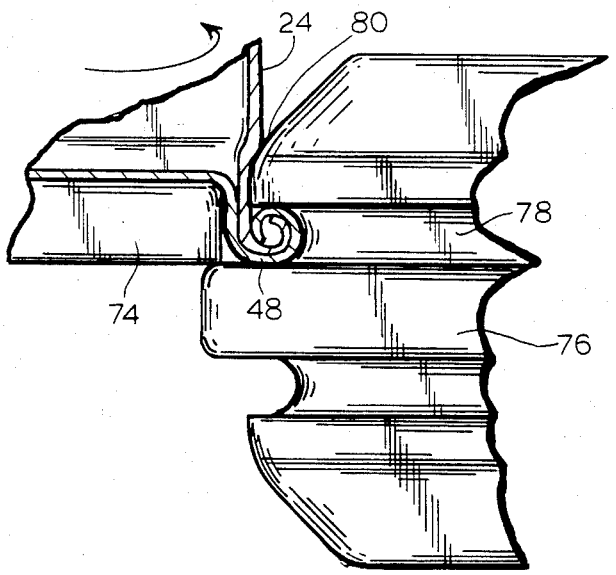
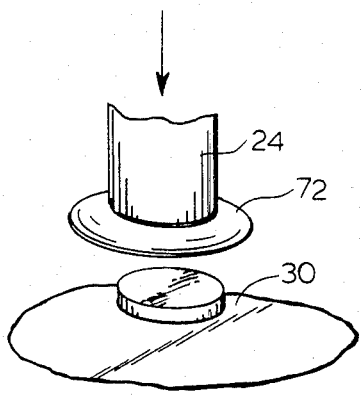
FIG.8

NESTING DRUMS-METHOD OF MAKING THE SAME

This is a division of application Ser. No. 468,951, filed Feb. 23, 1983.

This invention pertains to a method for making drums and more particularly a method of making drums which can be nested into each other while they are empty.

BACKGROUND OF THE INVENTION

Drums have been used for a long time for both transporting all kinds of goods and storing them. Usually, most drums are suitable for solid, semi-solids (i.e., powder) and liquid products. Because such drums are subject to very severe conditions during their transportation, these drums must be solidly built. However, it is also desirable to have drums which are light so that they are cheaper to manufacture and add less to the overall shipping costs of goods. Thus, the recent trend in drum making has been to reduce the thickness of the walls of these drums, especially for metal drums. However, naturally, this economic move led to drums that were less sturdy than the drums made of heavy gauge metals, especially around the bottom.

A further problem with metal drums has been that the drums occupy too much space when they are shipped empty from the place of manufacture to the customer, or even when they are stored. Inherently, such bulky items are costly to ship or store. One method which reduces this problem is to build drums which can be partially inserted one into the other, i.e., nested. Although some drums built previously allowed nesting at some space savings, it was found that the savings were inadequate.

SUMMARY OF THE INVENTION

The foregoing disadvantages are effectively overcome by the present invention which permits the shipping and storing of empty drums by nesting of drums more efficiently.

Another object is to provide a drum and a method of making said drum with a stronger bottom so that the drum can support a lot of weight and be sturdier while being made out of a thinner stock.

Other objectives and advantages shall become apparent from the detailed description.

The drum in accordance with this invention comprises a cylinder shell with at least one open end, and a closure having an inverted-plate shape with raised circular center and a cylinder side with a plurality of ribs extending radially outward from the side of the center. The closure is joined to the end by a circumferential seam. The ribs of the closure re-enforce the bottom of the shell at the seam and support the periphery of the shell during the seaming operation.

The drum is made by first separately making the shell and the closure by standard manufacturing methods and then they are associated by affixing the shell and the closure to a rotating turntable and then pressing the two parts successively against a first forming roller, and a second forming roller.

BRIEF DESCRIPTION OF THE DRAWINGS

FIG. 1 shows a general view of the drum;

FIG. 2 shows a side sectional view of the seam between the shell and the closure;

FIG. 3 shows a comparison between the way existing drums are nested and the way the drums built according to the invention are nested;

FIG. 4 is a bottom sectional view of the partially completed seam between the shell and the closure;

FIG. 5 is an isometric view of the closure before it is attached to the shell;

FIG. 6 is a plan view of the closure;

FIG. 7 is a sectional view of the closure;

FIGS. 8–12 show the intermediate steps used to attach the closure to the shell.

DETAILED DESCRIPTION OF THE PREFERRED EMBODIMENT

Figure 11:
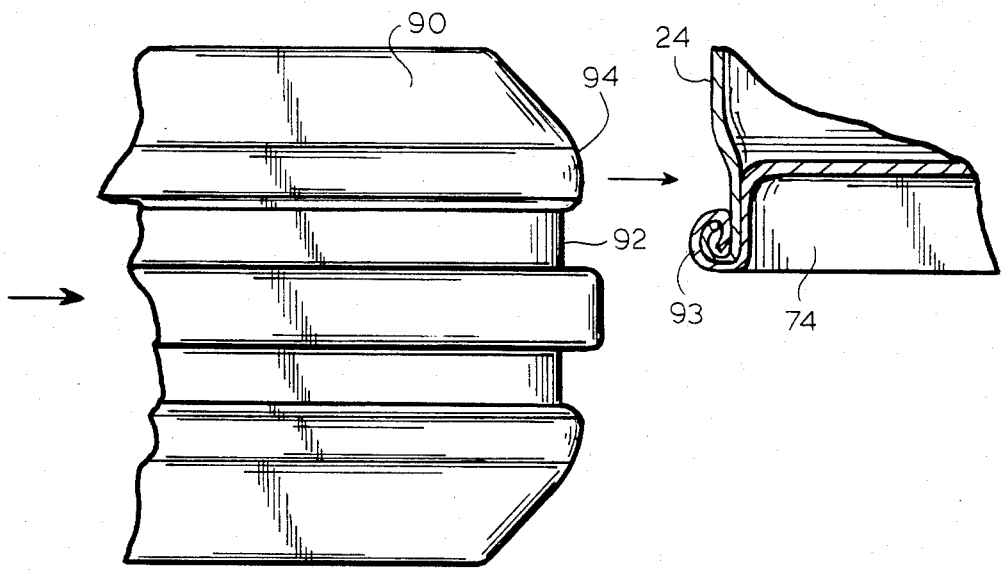

A multi-gallon capacity drum 10 built according to the present invention is shown in FIG. 1. It comprises a generally cylindrical shell 20 and closure 30. FIG. 1 also shows a removable top 40 which normally is installed on the drum after the drum has been filled. Shell 20 has a circumferential hoop 22, at its midsection. The function of this hoop shall be explained later.

The lower portion of the shell 24 may be slightly tapered. As it can best be seen in FIG. 2, the shell and the closure 30 are joined by a double seam 26.

Just above the double seam 26, the shell is necked in as at 28 to provide an annular cavity for the double seam, thus allowing the outer surface 32 to be disposed radially inward with respect to the shell. The effect of the necking, in other words, is that the outermost circumference of the seam 26 is smaller than the smallest circumference of the shell not counting the necking.

Therefore, if an imaginary line A—A (shown in FIG. 2) is drawn downward from the lower portion 24, it does not cross the seam 26.

The advantage of this construction is illustrated in FIG. 3. In this figure the numeral 120 indicates a drum in which another drum is to be nested. A conventional drum such as 60 has a seam 62 which projects out from the body of the drum. However, a drum 20 constructed in accordance to this invention goes in deeper than the conventional drum by a distance C, thus providing a more efficient nexting. Hoop 22 is provided to stop the upper drum at the mouth of the lower drum 120 generally indicated by line B—B to allow easy removal of the upper drum. The tapered lower shell of the drum also facilitates the nesting operation.

As previously stated, the closure 30 of the drum is provided with several lateral re-enforcing ribs. These ribs 34 can be seen in FIG. 4. The method of making these ribs and the double seam 26 are described below.

The closure 30 of the drum is made separately by standard methods and its shape prior to the seaming process as shown in FIGS. 5–7. This closure has the general shape of an inverted circular plate. It has a center portion 42, with a ring-shaped depression 44, a disk 48 and a cylindrical side 46 which joins the center portion to the disk. Disposed on the side there are a plurality of triangular or other shaped ribs 34 extending radially outward from the side.

In order to make the double seam between the sidewall and the closure, an end of the shell is flared out to form an edge 72 on FIG. 8. The shell is then fitted over the closure. Advantageously, the ribs from a circle which has a diameter approximately equal to the inner diameter of the shell so that as the sidewall is placed over the closure, the ribs center the closure with respect to the sidewall. The primary function of the ribs at this point is to centralize the shell during the seaming operation.

The two parts are then affixed to a turntable 74 which presses the disk 48 and the edge 72 disposed above the disk against a forming roller 76. Forming roller 76 has an annular shoulder 80. The sidewall and the closure are rotated in one direction by the turntable and the forming roller is turned in the opposite direction, thus as the two turning parts are pressed together, the disk and the edge are forced to curl upwardly by the curved groove in the forming roller. At the same time, the annular shoulder 80 on the roller pushes the shell radially inward above the curling edge to form the necking which is normally done in a separate operation prior to seaming, as shown in FIG. 10.

Figure 12:
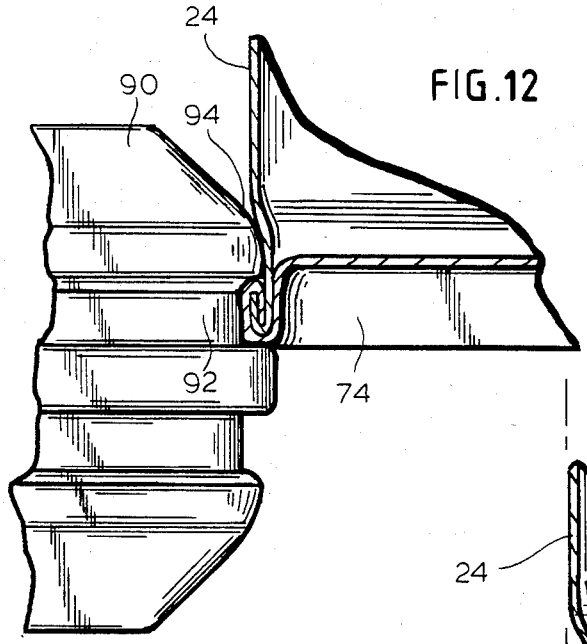
Figure 13:
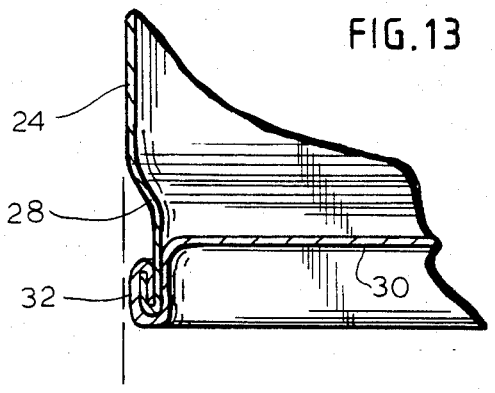
FIG. 13 shows a blown-up sectional view of the seam.

After the curling of the edge and disk are formed into a roughly circular seam as at 93, a second forming roller 90 with an annular straight groove 92 and annular shoulder 94 is pressed against the circular seam to flatten it into a double seam and at the same time, form the straight outer wall 32, as shown in FIGS. 11, 12 and 13.

During this whole process, the ribs 34 ensure a close cooperation between the closure and the shell. As it can be seen in FIG. 4, the ribs in effect act as a corrugative re-enforcement to the seam. Thus the ribs which are crushed against the bottom portion of the shell co-operate with the said sidewall to produce a strong ring-shaped support structure for the drum.

One skilled in the art will appreciate the fact that the necked-in portion of the drum not only forms a cavity for the double seam, but also permits the use of a smaller closure 30 than would be needed for a standard shaped drum with a corresponding saving in materials.

Thus, the objects and advantages of the invention are attained, the scope of the invention is to be determined by the appended claims.

I claim:

1. A method of making a nestable drum comprising:

providing a cylindrical shell with one end having a first diameter;

flaring out a portion of said one end to form an edge;

providing a circular plate-shaped closure with a raised center, a disk, and a cylindrical side connecting said center to said disk, said side having a second diameter smaller than said first diameter and a plurality of ribs extending radially away from said center to form a circle having an outer diameter equal to said first diameter;

associating the shell with the closure so that the edge coincides with the disk and the center and the ribs are disposed within the shell; and curling the edge and the disk together to form a seam.

2. The method of claim 1 wherein after the association of the shell and the closure, the open end and the ribs are reduced to form an annular space around the open end and to reinforce said seam.

3. The method of claim 2 wherein the shell is also necked in radially above the edge to form an annular cavity for the seam.

4. The method of claim 3 also comprising compressing the seam radially inward into the annular cavity.

5. The method of claim 4 wherein the curling is accomplished by affixing the closure and the shell to a turntable and pressing said edge and disk against a first roller which has at least one annular groove with a circular side whereby the edge and the disk are curled within the annular groove of the roller to form a seam which is cross sectionally circular.

6. The method of claim 5 wherein the first roller also has an annular shoulder so that as the annual groove curls from the seam, the shoulder forms the necking of the shell.

7. The method of claim 3 further comprising of pressing the cross-sectionally circular seam against a second roller to flatten the circular seam into a double seam.

8. A method of producing a nestable drum comprising:

providing a shell with at least one open end having a first diameter;

providing a closure with a raised center and a cylindrical side having a second diameter, said closure being formed with a plurality of ribs extending radially from said cylindrical side which generate a circle of said first diameter;

associating said closure to said shell by axially inserting said raised center into said open end;

reducing said open end and said ribs to form an annular space around said open end; and, forming a seam between said closure and said shell whereby said ribs reinforce said seam.

9. The method of claim 8 wherein said reducing and said seam forming is performed simultaneously.

10. The method of claim 8 wherein said seam is formed within said annular space.

* * * * *